United States Patent [19]

Massin

[11] 4,126,301

[45] Nov. 21, 1978

[54] CONTAINERS FOR MOLTEN METAL

[75] Inventor: Daniel M. Massin, La-Celle-Saint-Cloud, France

[73] Assignee: Foseco Trading AG., Chur, Switzerland

[21] Appl. No.: 838,055

[22] Filed: Sep. 30, 1977

[30] Foreign Application Priority Data

Oct. 7, 1976 [GB] United Kingdom ..... 41786/76

[51] Int. Cl.[2] ..... C21C 7/00

[52] U.S. Cl. ..... 266/280

[58] Field of Search ..... 52/61, 62, 396, 401, 52/573, 598, 599; 266/280–286, 287, 275

[56] References Cited

U.S. PATENT DOCUMENTS

| | | | |
|---|---|---|---|
| 2,075,955 | 4/1937 | Parsons | 52/401 |
| 2,130,788 | 9/1938 | Boyd | 52/401 |
| 2,316,660 | 4/1943 | Bailey | 52/573 |
| 2,858,695 | 11/1958 | Loughborough | 52/573 |
| 3,415,483 | 12/1968 | Charman et al. | 266/287 |
| 3,601,943 | 8/1971 | Danois | 52/573 |
| 4,012,029 | 3/1977 | Seguin et al. | 266/275 |

FOREIGN PATENT DOCUMENTS

| | | | |
|---|---|---|---|
| 1,364,665 | 8/1974 | United Kingdom | 266/282 |
| 1,431,652 | 4/1976 | United Kingdom | 266/280 |

*Primary Examiner*—Gerald A. Dost

*Attorney, Agent, or Firm*—Cushman, Darby & Cushman

[57] ABSTRACT

A molten metal container, e.g. a tundish, consists of an outer metal casing, usually a relatively permanent refractory lining and an inner expendable lining of refractory heat-insulating slabs, behind which slabs is a loose fill of particulate refractory material. In order that the loose fill material does not pass through the joints between the slabs, leaf-seals are provided at the joints between the slabs.

9 Claims, 3 Drawing Figures

CONTAINERS FOR MOLTEN METAL

This invention relates to containers for molten metal.

There is a wide variety of occasions in foundry and steelworks practice in which it is desired to transfer molten metal from one area to another and this is done by placing the molten metal in a vessel or passing it through a channel. In either case, it is customary to contain the molten metal in a rigid metal casing internally lined with refractory material. Permanent refractory linings tend to be expensive and easily damaged by molten metal and accordingly in recent years several systems have been proposed using in addition to a permanent refractory lining, an inner expendable lining usually made of slabs of refractory heat-insulating material. After use, the expendable lining may be discarded and the vessel or channel relined prior to the next use.

One such proposal is described in British patent specification No. 1,364,665 which described a tundish consisting of an outer metal casing, a relatively permanent lining of a refractory material and an expendable lining for contact with the molten metal and made up of a set of slabs of refractory heat-insulating material.

In such tundishes and similar vessels it is sometimes advantageous to provide between the expendable and permanent linings a layer of loose particulate material such as silica sand. One such system is described in British patent specification No. 1,469,513. The provision of such a layer gives a number of advantages, particularly the prevention of damage to the permanent lining and the outer metal casing, should molten metal penetrate the joints between the slabs forming the expendable lining. Furthermore, the layer of loose particulate material mechanically supports the expendable lining slabs evenly and minimises the risk of breakage under metallostatic pressure when the vessel is filled with molten metal. The overall heat-insulation is also improved.

One disadvantage of such systems using a loose particulate infill is a tendency for loose particulate material to pass through the joints between the slabs forming the expendable lining and into the central cavity of the container. Manual removal of any such material is time-consuming and inconvenient.

The problem may be avoided by mortaring the joints between the individual lining slabs making the expendable lining but this is likewise time-consuming and often inconvenient, particularly if the mortar needs to be dried out before molten metal is introduced into the vessel.

According therefore to a first feature of the present invention there is provided a molten metal container comprising an outer metal casing and an inner expendable lining made up of a plurality of slabs of refractory heat-insulating material, there being between the inner expendable lining and the metal casing a loose fill of particulate material, and wherein at least some of the joints between the slabs forming the expendable lining comprise a leaf seal member adapted to restrain movement of the loose particulate material across the joint.

The container may have a relatively permanent lining of refractory material between the metal casing and the expendable inner lining.

Between adjacent side-by-side slabs on a side wall of the container, it is desirable to provide a leaf seal in each case.

The leaf seal may take a wide variety of forms and is preferably provided along the edge of only one of two abutting slabs, though both abutting edges may bear leaf sealing members if desired. The seal may be resilient or merely pivotally mounted and may hinge or bend about an appropriate line along or adjacent the edge of the lining slab. Most preferably, the leaf seal is mounted to flex or hinge about the jointing edge of the slab nearest the interior of the container.

The leaf seal may be made of a wide variety of materials such as thin metal foil, paper, card or plastics. If the seal is resilient, the edge of the seal remote from the slab when unstressed should be located at a distance from the body of the slab greater than the width of a properly assembled joint between two slabs.

The present invention further provides lining slabs formed of refractory heat-insulating material and suitable for use in molten metal containers as defined above, the lining slabs having along one edge a leaf seal member adapted to form a seal with an abutting edge of an adjacent like slab.

The invention is illustrated by way of example with reference to the accompanying drawings in which.

Figure 1:
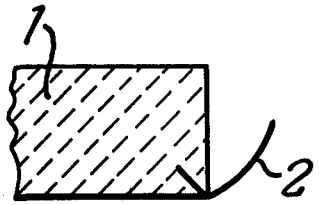
FIG. 1 is a cross-section through one end of a lining slab according to the present invention not in use.

Referring to the drawings, a lining slab 1 is formed of particulate refractory material, fibrous material and a binder. This slab may be formed of any composition suitable for the purpose and a wide variety is known from the literature. Partly embedded in the slab is a flexible leaf 2 which extends from one edge of the slab as shown.

Figure 2:
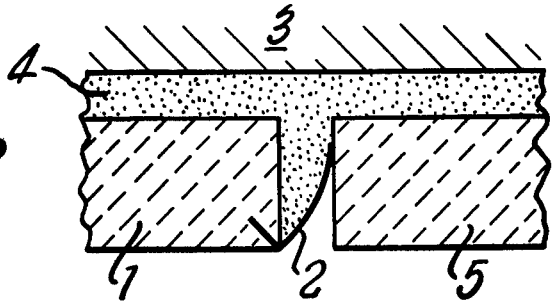
FIG. 2 is a view of the lining slab of FIG. 1 together with an adjacent lining slab in section in use.

When the slab is inserted into a tundish to line it as shown in FIG. 2 in section, it is placed near to a permanent refractory brick lining 3 and the space between the slab 1 and the permanent lining 3 is filled with loose refractory material 4. During filling the loose refractory material 4 presses the leaf 2 into the position shown so that it lies sealingly against the edge of the adjacent slab 5.

Figure 3:
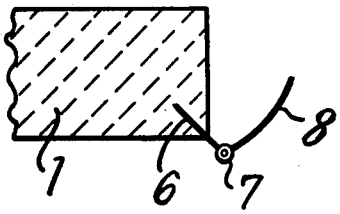
FIG. 3 is a section similar to FIG. 1 but of an alternative construction.

In FIG. 3 there is shown an alternative in which leaf 2 is replaced by a hinged member consisting of a part 6 embedded in the slab, a hinge device of known type 7 and a swingable flap 8. The functioning is effectively the same as that for the slab shown in FIG. 1.

It is observed that during use the leaf seal will usually be destroyed by the heat of the molten metal in the container, but by that time, it has served its function of holding the loose fill behind and between the lining slabs. The loose fill will not thereafter come into the cavity of the molten metal container on account of the metallostatic pressure retaining it in place.

I claim:

1. In a molten metal container including an outer metal casing, an inner expendable lining made up of a plurality of slabs of refractory heat-insulating material, and between the inner expendable lining and the metal casing, a loose fill of particulate material, wherein the improvement comprises means for sealing at least some of the joints between the slabs forming the expendable lining so that the movement of loose particulate material across the at least some joints is restrained, said means including a leaf seal member mounted on at least one slab to flex or hinge about or adjacent the jointing edge of the slab nearest the interior of the container.

2. The molten metal container of claim 1 wherein a leaf seal is provided between each of adjacent slabs in side-by-side relation lining the side walls of the container.

3. The molten metal container of claim 1 wherein the leaf seal member is made of a material selected from the class consisting of thin metal foil, paper, card and plastics.

4. The molten metal container of claim 1 wherein the leaf seal member is resilient, the edge of the seal remote from the slab when unstressed being located at a distance from the slab greater than the distance between adjacent slabs.

5. A lining slab for use in a molten metal container, said slab comprising a body of particulate refractory material, fibrous material, and a binder, suitable for withstanding the conditions existing at the lining for a molten container, said body including two parallel faces, and a plurality of edges, and a leaf seal member formed integrally with said body and along or adjacent at least one edge thereof, said member extending from a point adjacent one face of said body, spaced the entire thickness of the body from the edge with which it is associated, and toward the other face of said body.

6. The slab of claim 5 wherein the leaf seal member is a strip of material hinged to one corner edge of the slab.

7. The slab of claim 5 wherein the leaf seal member is a resilient strip of material affixed to the edge of the slab.

8. The slab of claim 5 wherein the leaf seal member is made of a material selected from the class consisting of thin metal foil, paper, card and plastics.

9. A lining slab as recited in claim 5 wherein the length of said leaf seal member from the edge of said body with which it is associated is less than the thickness of said body.

* * * * *